United States Patent [19]

Taub

[11] 4,411,382

[45] Oct. 25, 1983

[54] ERECTABLE DISPLAY ASSEMBLY WITH SELF-CONTAINED PACAKGED PRODUCT

[76] Inventor: Ronald H. Taub, 154 Sheridan Rd., Highland Park, Ill. 60035

[21] Appl. No.: 390,257

[22] Filed: Jun. 21, 1982

[51] Int. Cl.[3] ..... B65D 5/52; B65D 25/24

[52] U.S. Cl. ..... 229/16 D; 206/45.25; 206/45.27; 248/174

[58] Field of Search ..... 248/174, 170, 152; 211/133, 132, 72; 206/45.14, 45, 45.15, 45.18, 45.19, 45.2, 45.22, 45.25, 45.27; 229/16 D

[56] References Cited

U.S. PATENT DOCUMENTS

| | | | |
|---|---|---|---|
| D. 190,941 | 7/1961 | Caldwell | 248/174 |
| 1,064,813 | 6/1913 | Bloomberg | 206/45.14 |
| 2,027,079 | 1/1936 | Weiss | 206/45.14 |
| 2,041,751 | 5/1936 | Folsom et al. | 248/174 |
| 2,119,382 | 5/1938 | Cooper | 206/45.14 |
| 2,229,257 | 1/1941 | Reaume | 229/16 D |
| 2,940,710 | 6/1960 | Adams | 229/16 D |
| 2,940,710 | 6/1960 | Adams | 248/174 |
| 3,918,576 | 11/1975 | Taub | 229/16 D |
| 4,197,939 | 4/1980 | Dogliotti | 248/174 |

*Primary Examiner*—Joseph Man-Fu Moy

[57] ABSTRACT

A standing display assembly including a floor base surmounted by, interlocked with, and supporting a display tray for containing items to be promoted for sale. Wing-like side panels hingedly joined to the tray at lateral edges thereof and extending rearwardly and outwardly carry imprinted graphic descriptive and advertising indicia, which indicia are thus rendered visible and readable from the front and also from each side of the erected assembly. The floor base is readily collapsible along pre-formed fold lines to assume a substantially flat packet, the resulting compact being dimensioned to permit packaging thereof within the tray, together with the sale items, whereupon the tray is simply and readily closable to provide a complete, unitary, compact package for shipment and storage.

25 Claims, 15 Drawing Figures

300
386
380
396
390
360
366
372
356
350
354
374
368
362
388
382
392
398
410
408
420
420
402
416
346
352
344
404
420
328
326
312
314
322
320
320a
306a
306
340
340
304
304a
308
308a
322a

184

220
234
236
222
238
226
230

ERECTABLE DISPLAY ASSEMBLY WITH SELF-CONTAINED PACAKGED PRODUCT

BACKGROUND OF THE INVENTION

The present invention relates to an improved display assembly of the floor standing type and which includes a base together with a surmounted display tray in which the articles to be sold are contained. More particularly, the invention is directed to an improved display assembly which has enhanced viewing capabilities so that the advertising indicia are readily perceptible from the front of the assembly as well as from each of the sides. The display assembly is further characterized in that it may be compactly collapsed and folded so that the base may be packaged, together with the articles to be sold, in the display tray component of the assembly.

The display assembly of the invention is of the type which is compact in its shipment and storage configuration, but which may be readily set up or assembled to provide a functional, durable display for the promotion of point-of-sales merchandise. Generally, such structures are known in the prior art, such prior art also including display assemblies which combine, in cooperative combination, a base surmounted by a display tray. For example, such a general structure is described in Taub U.S. Pat. No. 3,164,350. Another form of a base surmounted by a tray structure is described in Taub U.S. Pat. No. 4,274,613. While the assembly of the present invention is of the general "class" to which the above-referred to displays belong, and while each of the above-referred to display assemblies has meritorious features, the present invention includes important differences from the structures described in the prior art and offers advantages not heretofore realized.

SUMMARY OF THE INVENTION

The present invention pertains to a self-supporting display stand fabricated of corrugated paper board or the like and constituting a base and tray surmounting the base and supported thereon. In a preferred embodiment of the invention, the tray is mechanically intercoupled with the base to establish a secure and stable assembly. It is an important feature of the invention that the base is collapsible along preformed fold lines and that in its collapsed and compact form it may be packaged within the tray portion of the assembly.

A related feature of the invention is that the display tray includes, during shipment, not only the collapsed and folded base, but the articles themselves, which are to be displayed and sold.

It will be appreciated that in accordance with the features of the display of the present invention, upon receipt of the unitary package at the site at which the articles contained in the package are to be displayed and sold, it is necessary merely to open the tray-like box, remove and set up the base contained in that box, position the tray, containing the articles to be sold, to surmount the base, whereupon the entire display is in its functional product-promoting mode.

It is a further feature of the display assembly of the invention that the tray carries wing-like side panels which are hingedly joined to the tray at lateral edges thereof and which extend rearwardly and outwardly from the forwardly presented side edges of the tray itself. The rearwardly and outwardly extending panels are imprinted or otherwise decorated to include graphic description and advertising indicia, which indicia are readily visible and readable from the front and also from each side of the erected assembly.

It is a related feature of the invention that the tray is also provided with a placard or header card which projects upwardly from the top edge of the tray and carries additional promotional material descriptive of the product being offered for sale.

It is an important structural feature of the display stand of the invention that the base is provided with integrally-connected, laterally extending panels which are formed to include tabs for mating in interlocking engagement with cooperating slots formed in the tray portion of the assembly, thereby to stabilize and secure the base-carried tray firmly in place on the supporting base.

A related feature of the display assembly is that the tray is formed to include, as an integral extension from the top edge of the lower side wall a skirt-like extension which projects into the base, interiorly thereof and in lateral abutment against the opposed sidewalls of the base for stabilization thereof.

Yet another feature of the display assembly of the invention that each of the base component and the tray component is formed from a single blank of sheet material.

Another structural feature of the display assembly of the invention is that the header card is pivotal about its hinged joinder to the top of the tray for positioning within the tray itself to overlie the contents thereof during storage and shipment of the compact assembly.

Yet another important feature of the display assembly of the invention is that the wing-like panels secured at the top of the side walls of the tray are pivotal inwardly to overlie the contents of the tray, including the collapsed and folded base of the assembly and the articles to be displayed for sale, in preparing the assembly for storage and shipment.

Additional features, objects and advantages of the present invention will become apparent to persons skilled in the art upon consideration of the following specifications taken in conjunction with the drawings.

BRIEF DESCRIPTION OF THE DRAWINGS

FIG. 16 is a plan view of a pre-cut and prescored blank for constructing the tray of the display assembly, with the header card attached.

DESCRIPTION OF THE PREFERRED EMBODIMENT

Figure 1:
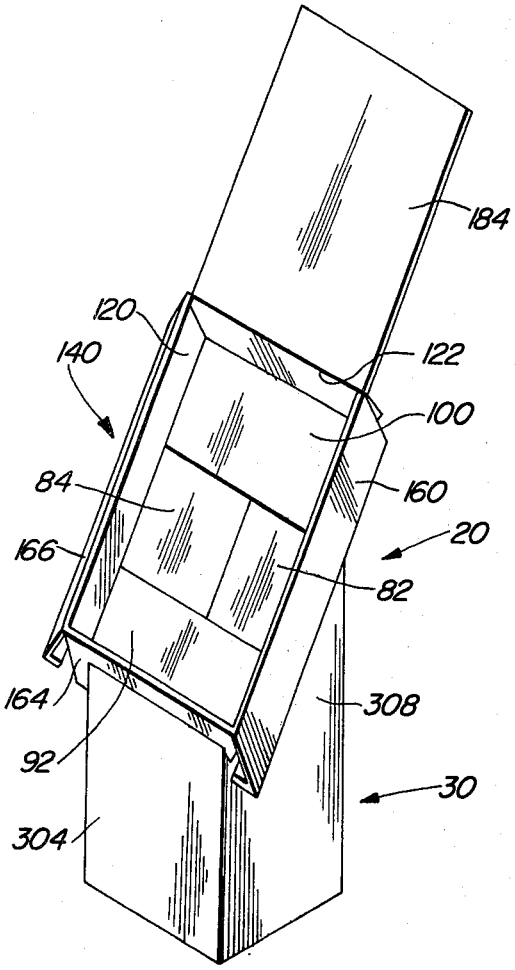
FIG. 1 is a perspective view of the display assembly of the invention in its erected mode, the contents of the tray having been removed to enhance clarity.
Figure 2:
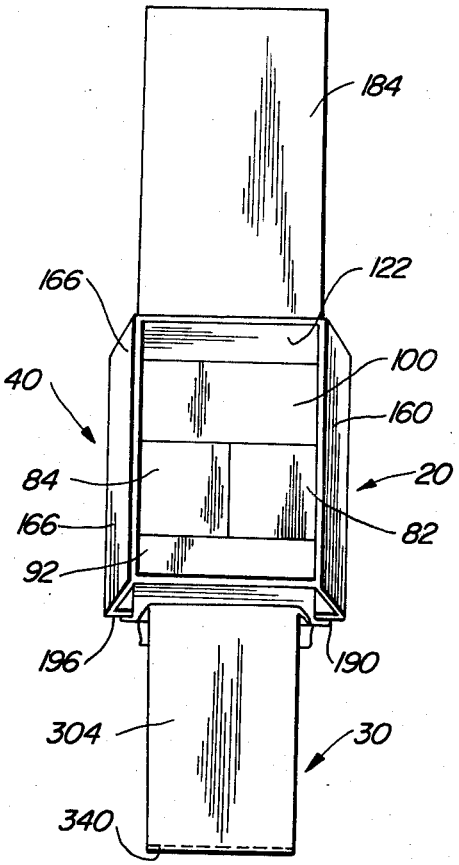
FIG. 2 is a front elevational view of the assembly of FIG. 1.
Figure 3:
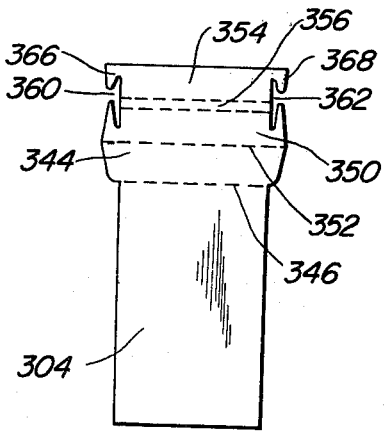
FIG. 3 is a front elevational view of the base component of the assembly prior to completion of the erection process.

A complete display assembly 20, in accordance with the invention, in assembled, functional form, is shown in FIG. 1. As illustrated, the display assembly 20 includes a base 30, a rectangular box-like tray or merchandise container 40 supported on the base 30, and a header card or placard extending upwardly of the tray 40. For clarity of illustration, articles of merchandise usually housed in the container 40 have been removed.

In the preferred embodiment of the display assembly 20 illustrated, the box-like tray 40 is supported to extend upwardly and rearwardly at an angle (FIG. 1). Intercoupling and interlocking means are provided between the tray 40 and the base 30 to ensure a stable mechanical structure. The preferred manner in which this is achieved is set forth hereinbelow.

It is an important feature of the invention that the box-like tray 40 is integrally formed with a pair of wing-like side panels and joined to and projecting laterally and rearwardly from opposed top edges of the respective side walls of the tray 40. The panels carry advertising matter or other descriptive and promotional literature (not shown). Due to the novel and unique disposition of the panels, the promotional material there set forth can be seen both from the front of the display assembly and from either of the opposed sides.

Figure 15:
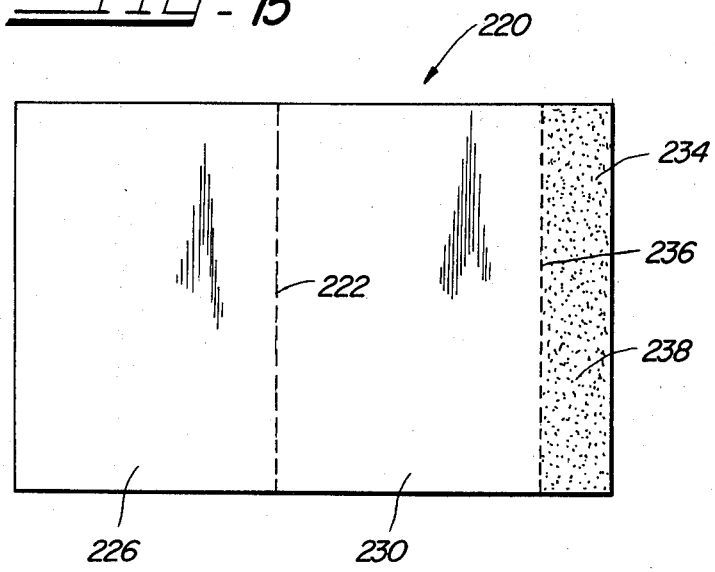
FIG. 15 is an plan view of a sleeve for superimposing on the header card.

The tray 40 of the assembly appears in it erected form as a generally rectangular box, but includes lateral as well as upper and lower appendages finding special utility in the practice of the present invention. As shown in FIG. 16, the tray 40 is formed from a single pre-cut and pre-scored blank 70 of sheet cardboard. In FIG. 15, cuts in the body of the blank 70 are shown as solid lines, and pre-scoring is illustrated by dotted or broken lines.

Referring now more particularly to FIG. 16 itself, the blank 70 includes sections defining the various components of the tray itself as well as the unique appendages. Specifically, the blank 70 includes a pair of elongated right and left floor panels 82 and 84. Interposed between these floor panels and separated therefrom by parallel cuts 86 and 88 is a lower floor panel 92, and in line with panels 82, 92 and 84, and separated from the latter by a through-cut 96 is a floor panel 100 at the upper or top portion of the tray in the assembled mode.

Disposed laterally of and linearly co-extensive with the floor panels 82, 92, 84 and 100, and separated from the latter along fold lines 102, 106, 108, and 110 are, respectively, a right side wall 114, a lower end wall 116, a left side wall 120, and an upper end wall 122. A fold line 130 is at the juncture of the right side wall 114 with the lower end wall 116, a fold line 134 is at the juncture of lower end wall 116 with the left side wall 12, and a fold line 138 defines the juncture between the left side wall 120 and the upper end wall 122.

Linearly co-extensive with the floor panel elements and the wall elements of the tray and joined to the latter along fold lines 142, 146, 150 and 152 are a right wing panel 160, a pivotal skirt 164, a left wing panel 166, and an upper hinge panel 170. The panels are separated from one another by precuts 174, 176, and 180. Fastened to to overlie and extend from the hinge panel 170 is a header card 184.

Referring further to FIG. 15, attached to and extending co-linearly with the right wing 160 is a right flange 190 joined to the right wing 160 along a prescored fold line 192. A left flange 196 is co-extensive with the left wing 166 and joined thereto along a fold line 200. Through slots 204 and 208 are formed respectively in the zone of juncture between the right flange 190 and right wing 160, at the fold line 192 and at the juncture of the left wing 166 and left flange 196 along the fold line 200.

Attached to and extending from the pivotal skirt 164, as an extension thereof, is a tongue 210.

Figure 4:
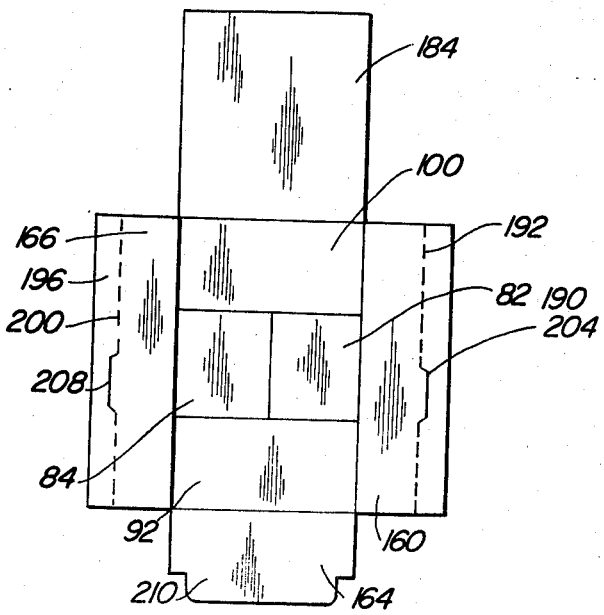
FIG. 4 is a plan view of the empty tray of the display assembly, in its open configuration.
Figure 5:
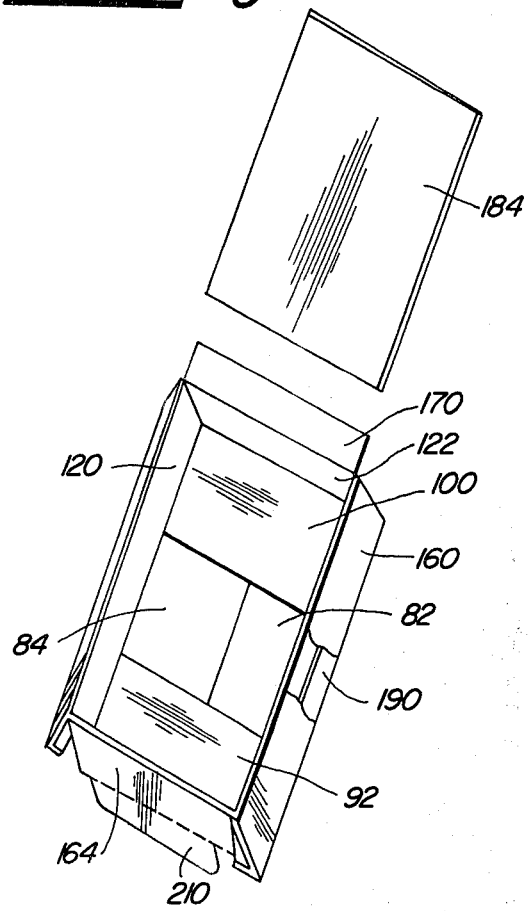
FIG. 5 is a perspective view of the tray of the assembly with portions cut away, and suggesting, schematically, how the header card is attached to the tray flap.
Figure 6:
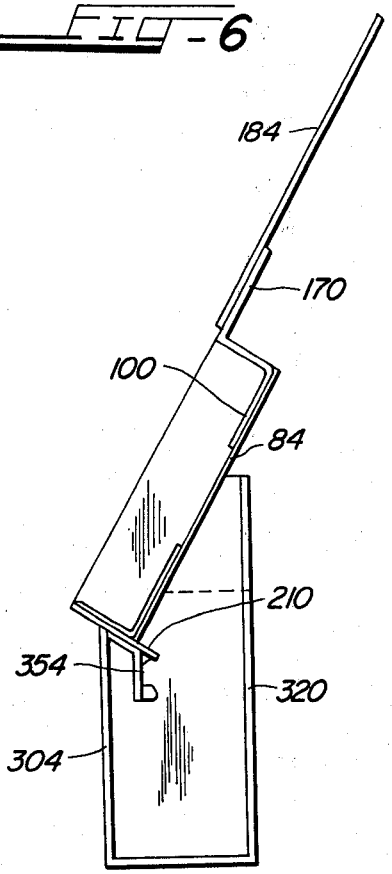
FIG. 6 is a cross sectional view of the assembly taken substantially on the lines 6—6 of FIG. 2.

The sheet blank 70 is readily converted into the box-like tray 40 of the display assembly of the invention by folding the blank 70 upwardly along the fold lines 130, 134 and 138 while concurrently folding the floor panels inwardly along fold lines 102, 106, 108 and 110, in a manner so that when looking inwardly into the box so formed, the panels 92 and 100 overlie the right and the left floor panels 82 and 84 (FIG. 4). The opposed ends 220 and 224 of the blank 70 are then joined in lineal abutment by means of any suitable tape or equivalent fastener means.

As a practical matter, the box-like tray 40 of the display assembly is completely pre-assembled (as a box) by the manufacturer so that no taping or gluing is necessary when the assembly is received at the point of use.

Figure 13:
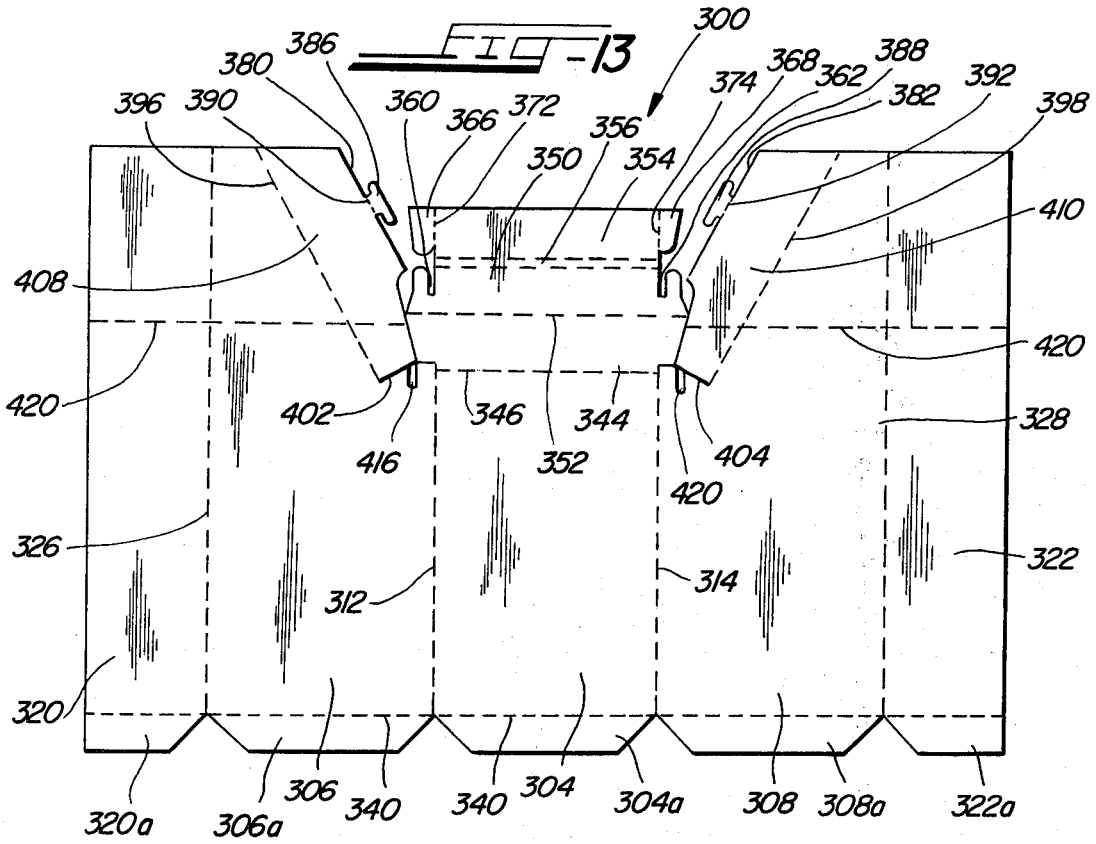
FIG. 13 is a plan view of a pre-cut and pre-scored blank for constructing the base of the display assembly.
Figure 14:
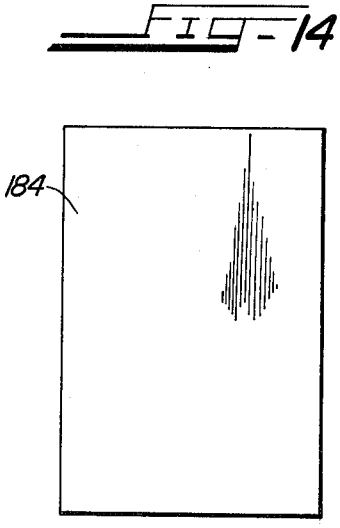
FIG. 14 is a plan view of the header card of the display assembly.

As in the case of the tray 40, the base 30 is also preferably fabricated of a single blank 300 of sheet corrugated board or the like. As shown in FIG. 13, the blank of the base includes a front panel 304, a pair of side walls 306 and 308 joined to the front wall 304 along preformed fold lines 312 and 314. A pair of rear panels 320 and 322 (partial) are joined, respectively, to the left side wall 306 and to the right side wall 308 of the base 30 along corresponding preformed fold lines 326 and 328.

The lower marginal portion of the entire base 30 is formed with a horizontally extending preformed fold line 340 which defines, at the lower extremity of each of the wall panels of the base 30 inwardly foldable webs 304*a*, 306*a*, 308*a*, 320*a*, and 322*a*. These webs, which, in combination, define an internal rim within the base 30, in the erected mode of the base, also provide a "finished" appearance in the base itself and an asthetically more pleasing visual presentation.

Referring further to FIG. 13, the front wall 304 of the base 30 is surmounted at its upper extremity by an integrally connected series of panels including a lintel 344 joined to the front wall 304 at a preformed fold line 346, a web 350 joined to the lintel 344 by means of a preformed horizontally extending fold line 352, and a shelf 354 joined to the web 350 by means of a horizontally extending double fold line 356. The lintel is of a lateral expanse somewhat greater than the width of the front wall 304, and is formed with a pair of opposed slots 360 and 362 adapted to receive corresponding opposed side walls 306 and 308 therewithin upon transformation of the base 30 into its functional disposition.

The shelf 354 is formed at its lateral extremities with a pair of flaps 366 and 368 joined to the shelf 354 proper along preformed vertical fold lines 372 and 374. The lateral dimension as measured across the shelf 354 is substantially equal to the lateral dimension of the front wall 304 so that when the shelf is inserted into the assembled base, the flaps 366 and 368 extend essentially normally of the shelf 354 and contiguously against the opposed side walls 306 and 308 of the base 30.

Figure 7:
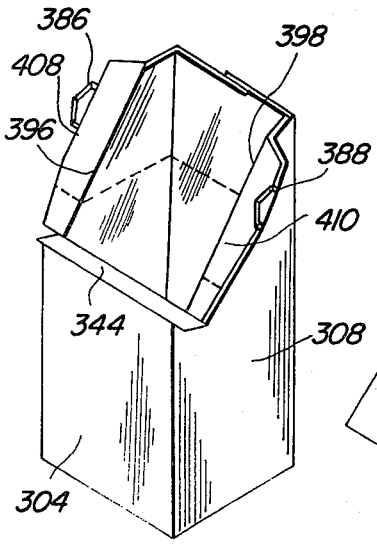
FIG. 7 is a perspective view of the assembled base of the display assembly in its fully set-up form.
Figure 8:
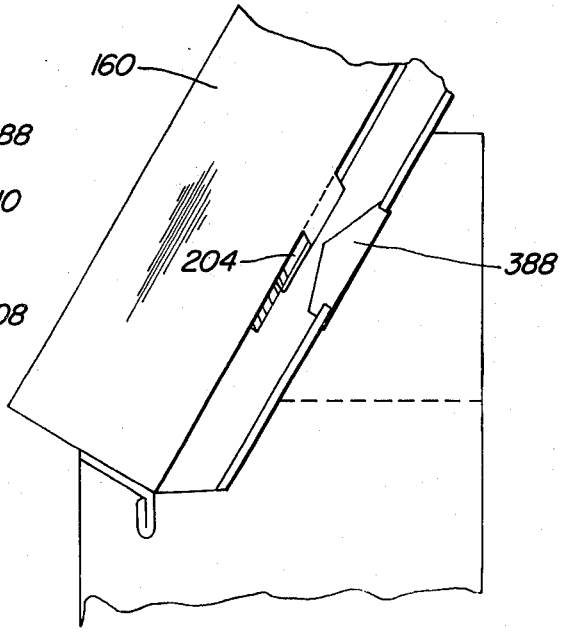
FIG. 8 is an enlarged, fragmentary view indicating, schematically, how the tray and the base are to be mechanically intercoupled.
Figure 9:
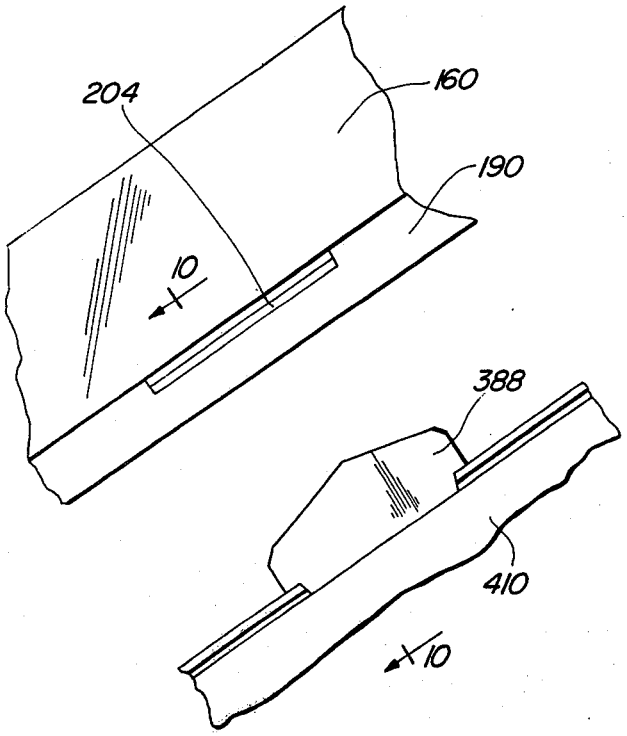
FIG. 9 is an enlarged, fragmentary view of those portions of the base and the tray encircled in FIG. 8 and showing a tab of the base in line to engage within a slot of the tray.
Figure 10:
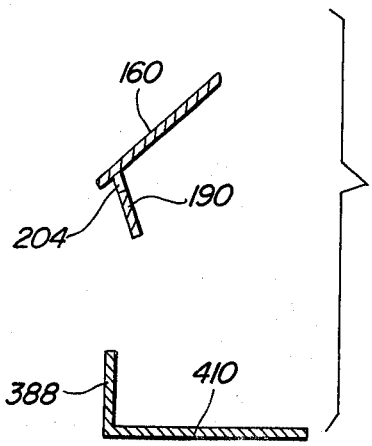
FIG. 10 is a cross-sectional view taken substantially on the lines 10—10 of FIG. 9.
Figure 12:
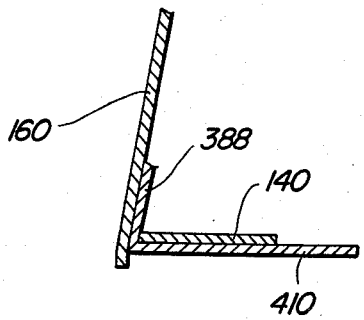
FIG. 12 is a cross-sectional view taken substantially on the lines 12—12 of FIG. 11.
Figure 11:
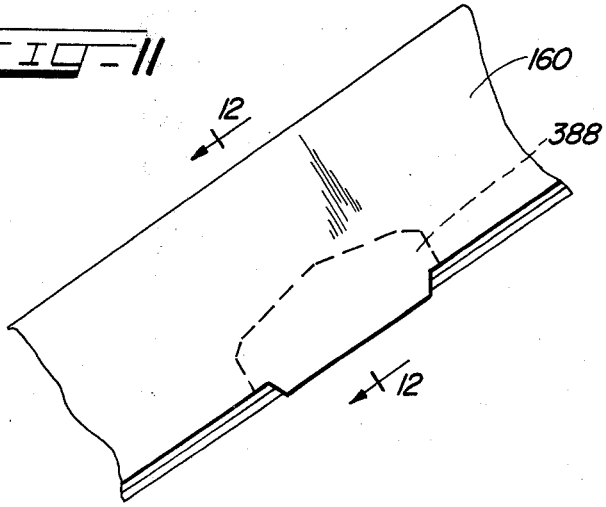
FIG. 11 is an enlarged, fragmentary view showing the established interlocking engagement of the base tab with the tray slot.

Referring now to the side walls 306 and 308 of the base 30, as shown in the blank 300, the inside upper corner portion of each of the left side wall 306 and the right side wall 308 is cut away to define an upwardly and outwardly directed edge 380 and 382 with an integrally formed projecting tab 386 and 388. The tabs are pivotal along preformed fold lines 390 and 392, whereby the tabs are orientable for interlocking engagement within respective cooperating slots 208 and 294 of the tray 40. A preformed fold line 396 and 398 in combination with an intersecting slit 402 and 404 demark in each of the respective side walls 306 and 308 a pivotal panel 408 and 410. When the base 30 is set up for its functional role, the panels 408 and 410 are disposed to extend outwardly from the respective side walls 306 and 398 at an angle (FIG. 7). Adjacent the base line slits 402 and 404 in the side walls 306 and 308, there is provided an upwardly opening slot 416 and 420 into which the folded-down web 350 is received when the base 30 is erected for use.

In order to convert the base blank 300 into the base 30 of the display assembly, it is necessary merely to fold the side walls 306 and 308 rearwardly to extend essentially normally of the front wall 304, and then to fold the rear wall components 320 and 322 toward one another to overlap, and to secure the contiguous overlapped portions of one another through the use of adhesives, clips or any other fastening means.

The resulting generally rectangular open-ended tubular structure is readily collapsible into a compact packet for incorporated in the box-like tray 40. The tubular structure is collapsed inwardly so that the right side wall 308 is brought into overlying engagement with the backwall 320 and 322 while, simultaneously, the front wall 304 is brought to bear contiguously against the left side wall 306. The thus-flattened assembly is then folded a second time so that the rear of the rear wall 320 and 322 overlies the left side wall 306 to provide a structure which has an overall width corresponding to that of either the front wall 34 or either of the side walls 306 or 308. Finally, the upper portion of the entire assembly, delineated as that portion above a preformed fold line 420 extending across the side walls 306 and 308 and the rear walls 320 and 322 (FIG. 13) is folded over and down and the front wall is folded over, rearwardly (at fold line 352). The resulting packet has an overall height corresponding essentially to the height of the front wall 304 plus the additional height of the surmounting lintel 344. As so collapsed, the resulting packet fits readily within the tray-like box 40.

With the compacted base 30 in place in the box-like tray 40 (and overlying the articles (not shown) previously packed into the tray 40), it is necessary merely pivotally to fold the header card 44 to overlie the entire packaged material and then to fold the pivotal skirt 164 into the tray 40 and, finally, to fold the right and left wing components 160 and 166, together with the attached right and left flanges 190 and 196 inwardly over the contents of the packed tray 40 as a closure therefor. The facing coextensive edges 424 and 426 are then taped together to establish a secure package ready for shipment to the intended destination, or for storage.

Upon arrival of the complete composite package at the point of use, it is necessary merely to slit the securing tape and to remove the folded base 30 element so that the entire display assembly may be quickly and easily erected.

The base 30 is shaped to define a generally squared tubular configuration, whereupon the two hinged panels 408 and 410 are displaced to extend, wing-like, somewhat laterally. With the shelf-supported flaps 366 and 368 (at side edges of shelf 354) folded upwardly along the fold lines 372 and 374, the shelf 354 and the attached web 350 are slidingly urged into the interior of the base in abutment with the opposed inner side surfaces of the side walls 306 and 308 of the base 30, with the skirt 164 coming to rest upon the lintel 344 of the base 30.

As indicated schematically in FIGS. 7 through 12, the opposed lateral right and left wings 160 and 166 of the tray 40 are urged to project somewhat rearwardly while the hingedly connected flanges 190 and 196 are urged toward the respective side walls 308 and 306 of the base 30, whereupon the tabs 360 and 362 hingedly attached to the panels 408 and 410 are inserted, respectively, into the slots 208 and 204 at the juncture of the tray wings 166 and 160 with their respective flanges 196 and 190 so that the tray 40 is firmly locked in place with the flanges 196 and 190 in abutment against the facing surfaces of the base panels 408 and 410, establishing a stable and secure display assembly.

In addition to the novel structural features of both the base 30 and the tray 40 of the invention and the novel and effective means by which the two component elements of the display assembly are secured in a stable configuration, the final display assembly, as erected, has the unique capability of presenting promotional and descriptive printed indicia (imprinted upon the wings 166 and 160 of the base-supported tray 40) which can be readily observed both from the front and from either side of the display assembly. Among the practical features of the display assembly is that as shipped to the site of ultimate use, it constitutes a very compact package. That package consists of a box-like tray which serves as the shipping carton itself, the articles to be displayed and sold, the base of the assembly folded into a substantially flat packet, and the header card. It will be appreciated that in the practical use of the display assembly of the invention, it is necessary merely to remove and to set up the base, to superimpose and interconnect the tray on that base, and to elevate the header card to its display mode. The articles to be displayed are immediately visible, as is desired in the ultimate use of the display assembly. There is no need to repackage or to rearrange these articles.

In one embodiment of the invention, it has been deemed desirable to provide means to impart greater versatility to the display assembly, especially in the effective use of the header card 184. To achieve this goal, there is provided the option of slidably positioning a sleeve over the header card 184. One form of such a sleeve is shown as a "blank" 220 in FIG. 15. As depicted, the sleeve is preferably fabricated of a single sheet of light-weight paper board or the like.

The blank 220 is provided with a transverse preformed fold line 222 which divides the blank 220 into two panels 226 and 230 each having a lateral expanse corresponding essentially to the width of the header card 184. One end of the sleeve blank 220 is integrally joined to a flap 234 along a preformed fold line 236. The flap 234 is coated with a glue or a protected pressure sensitive adhesive 238.

In use, the sleeve blank 220 is wrapped around to embrace and envelope the header card 184, and is secured in place by folding over and fastening the flap 234 so that the header card 184 is superimposed by a sleeve-like structure. It will be appreciated that the outer, exposed surface of the positioned sleeve may be imprinted with any preferred promotional or descriptive material including legends, artwork, or other indicia. It will also be understood that the header card enveloping sleeve may be quickly and easily replaced by other sleeves carrying different "messages" or lauding a different feature or attribute of the product contained in the display assembly.

While the foregoing description of the invention has been made with respect to a preferred embodiment, persons skilled in the art will understand, in the light of the present disclosure, that numerous changes, modifications, and alterations may be made therein without departing from the spirit and scope of the appended claims.

What is claimed is:

1. A standing, self-supporting display assembly of corrugated paper or the like for displaying articles carried thereby, said display assembly comprising, in combination, a base, and a tray surmounting and supporting on said base, said base including an upstanding generally rectangular perimetric wall including hingedly joined front and rear walls and side walls, said base being collapsible along prescored fold lines to provide a compact packet for shipment and storage, said front wall of said base being of a lesser height than said rear wall and said front wall having generally horizontally extending upper edge for supporting said tray, said tray having a lateral width exceeding that of said base, each of said side walls of said base defining a pair of upwardly presented intersecting edge means for support of said tray thereon, said pair of intersecting edge means each including first edge means and second edge means disposed to extend substantially at 90° to one another and each pair of said edge means adapted to support respectively a lower end panel and a floor panel of said tray carried by said base, each of said pair of said intersecting edge means intersecting at a locus generally forwardly in respective opposed said side walls and below said upper edge of said front wall of said base, said first edge means being angled rearwardly and downwardly from said upper edge of said front wall and said second edge means projecting upwardly and rearwardly from a lower terminus of said first edge means, said tray as supported on said base being disposed to project generally upwardly and rearwardly from said upper edge of said front wall of said base, and cooperating intercoupling means carried by said base and by said tray for securing said tray to said base.

2. The display assembly as set forth in claim 1 wherein said base is integrally formed with a pair of panels hingedly projecting laterally from respective said second edge means of said side walls of said base, each panel of said pair of panels carrying tab means joined to each panel at respective marginal side edges thereof and extending therefrom, and wherein said tray is formed with slot means adjacent lateral limits thereof for receiving said tab means of said base therewithin in interlocking engagement therewith.

3. The display assembly as set forth in claim 1 wherein said base is integrally formed with a pair of panels hingedly projecting laterally from respective said second edge means of said side walls of said base, each panel of said pair of panels carrying tab means joined to each panel at respective marginal side edges thereof and extending therefrom, and wherein said tray is formed with slot means adjacent lateral limits thereof for receiving said tab means of said base therewithin in interlocking engagement therewith, and wherein said tray opens upwardly and is generally rectangular in form having a floor and upper and lower end walls, and a pair of opposed side walls all connected to one another, and wherein said tray is integrally formed with a pair of wing-like panels joined to and projecting laterally and rearwardly from opposed top edges of respective said side walls of said tray, a pair of flanges joined to rearwardly projecting edges of said wing-like panels and extending generally normally thereof and toward said base, slot means in said flanges and positioned to receive said tab means therewithin in interlocking engagement therewith.

4. The display assembly as set forth in claim 1 and further comprising tray support lintel means integrally formed with said front wall of said base and projecting rearwardly of said top edge of said front wall of said base and inwardly thereof, said lintel means having a lateral width exceeding that of said base and having a pair of wings bridging and bearing upon upper edges of said side walls of said base, web means integrally formed with and extending downwardly from said lintel means and interiorly of said base with side edges of said web means in lateral abutment against opposed side walls of said base for stabilization thereof.

5. The display assembly as set forth in claim 4 wherein said web means is formed adjacent respective lateral limits thereof with downwardly opening slots for receiving opposed side walls of said base upwardly therewithin in locking engagement therewith.

6. The structure as set forth in claim 4 wherein said lintel means bears upon and is supported by said first edge means of said base at said side walls thereof.

7. The structure as set forth in claim 4 wherein each panel of said pair of panels is formed with a free bottom edge bearing on said lintel means at respective side margins thereof.

8. The structure as set forth in claim 5 wherein each panel of said pair of panels is formed with a free bottom edge bearing on said lintel means at respective side margins thereof, and wherein said pair of panels hingedly projecting from said side walls of said base and bearing on said lintel means constitute stop means precluding inadvertent withdrawal of said web means from lateral abutment with said side walls of said base.

9. The display assembly of claim 1 wherein said tray is generally rectangular in configuration and includes a pair of spaced upper and lower end walls and a pair of side walls connected at respective opposed edges of said end walls and extending therebetween, and further comprising a header card fastened to and carried by said tray at an upper end wall thereof.

10. The structure as set forth in claim 1 wherein said base is fabricated from a single blank of sheet material.

11. The structure as set forth in claim 1 wherein said tray is fabricated from a single blank of sheet material.

12. The display assembly as set forth in claim 3 and further comprising article description and sales promotion indicia imprinted on exposed outer and lateral viewing modes surfaces of said wing-like panels projecting from said side walls of said tray, and wherein said indicia are discernible in both frontal and lateral viewing modes.

13. The structure as set forth in claim 3 wherein said wing-like panels and said flanges joined thereto find utility as top closures for said tray during shipment of said display assembly.

14. The structure as set forth in claim 13 wherein said tray is adapted to retain therewithin during shipment thereof articles to be displayed in said tray during intended use of said display assembly.

15. The structure as set forth in claim 1 wherein said base is collapsible to provide a multi-layered compacted packet dimensioned overall for packaged insertion within said tray.

16. The structure as set forth in claim 9 wherein said header is hingedly connected to said tray at a laterally extending top edge of said upper end wall thereof, and wherein said header is selectively pivotal at said top edge of said upper end wall for stored positioning within said tray.

17. The structure as set forth in claim 1 and further comprising web means hingedly joined to said front and rear walls and to said side walls of said base at lower ends thereof along junctures defined by prescored horizontal fold lines, said web means being selectively pivotal about said fold lines to extend inwardly into said base and generally normally of said walls thereof.

18. The structure as set forth in claim 3 wherein said slot means is in a zone of juncture of said flanges with said wing-like panels of said tray.

19. A merchandise display assembly in accordance with claim 1 wherein said tray constitutes a generally rectangular merchandise container having a pair of hingedly pivotal side panels shiftable selectively between a first modal disposition in which said side panels overlie said tray and serve as closures therefor, and a second modal disposition in which said side panels are angled to project laterally and rearwardly from respective top side edges of said tray and present panel-imprinted indicia for perceptual viewing from both the front and from the sides of said display assembly.

20. The structure as set forth in claim 19 and further comprising first interlock means carried by said side panels for intercoupling engagement with cooperating second interlock means carried by said base, to stabilize said tray supported on said base.

21. The structure as set forth in claim 1 wherein said tray is generally rectangular in configuration and includes a pair of spaced upper and lower end walls and a pair of side walls, and further comprising a pivotal skirt hingedly joined to said lower end wall, lip means having a lateral expanse corresponding substantially to a width of said end walls, and greater than the width of said base, tongue means integrally formed with said lip means as an extension thereof, said tongue means being of a lesser width than said skirt and being dimensioned for entry interiorly of said base in substantial abutment with opposed laterally spaced sides of said base to intercouple said tray with and to stabilize said tray on said base.

22. The display assembly as set forth in claim 5 and further comprising shelf means integrally formed with and extending from said web means at a laterally projecting edge thereof and within said base, said shelf means abutting opposed side walls of said base interiorly thereof as a stabilizer therefor.

23. The display assembly as set forth in claim 22 wherein said shelf means is disposed to lie in a generally horizontal plane.

24. The display assembly as set forth in claim 22 and further comprising flap means integrally formed with said shelf means at opposed side edges thereof and lying contiguously against opposed inner faces of said side walls of said base.

25. A display assembly as set forth in claim 9 and further comprising sleeve means positionable to cover said header card thereby to facilitate selective presentation of promotional indicia imprinted on an outwardly presented planar face of said sleeve means.

* * * * *